US006417847B1

(12) United States Patent
Mametsuka

(10) Patent No.: US 6,417,847 B1
(45) Date of Patent: Jul. 9, 2002

(54) FLAT-PANEL DISPLAY DEVICE, ARRAY SUBSTRATE, AND METHOD FOR DRIVING FLAT-PANEL DISPLAY DEVICE

(75) Inventor: Koji Mametsuka, Ageo (JP)

(73) Assignee: Kabushiki Kaisha Toshiba, Kawaski (JP)

( * ) Notice: Subject to any disclaimer, the term of this patent is extended or adjusted under 35 U.S.C. 154(b) by 0 days.

(21) Appl. No.: 09/401,183

(22) Filed: Sep. 23, 1999

(30) Foreign Application Priority Data

Sep. 24, 1998 (JP) ..... 10-270171

(51) Int. Cl.[7] ..... G09G 5/00
(52) U.S. Cl. ..... 345/213; 345/206
(58) Field of Search ..... 345/98, 100, 94, 345/96, 208, 209, 210, 87, 58, 213

(56) References Cited

U.S. PATENT DOCUMENTS 4,651,148 A * 3/1987 Takeda et al. ..... 340/805
5,648,793 A * 7/1997 Chen ..... 345/96
5,914,699 A * 6/1999 Imamura ..... 345/99
5,959,600 A * 9/1999 Uchino et al. ..... 345/94
5,969,713 A * 10/1999 Tomizawa et al. ..... 345/198
6,232,945 B1 * 5/2001 Moriyama et al. ..... 345/98

FOREIGN PATENT DOCUMENTS

JP 6-202076 7/1994
JP 10-105126 4/1998

* cited by examiner

*Primary Examiner*—Vijay Shankar
*Assistant Examiner*—Nitin Patel
(74) *Attorney, Agent, or Firm*—Oblon, Spivak, McClelland, Maier & Neustadt, P.C.

(57) ABSTRACT

The present invention provides a flat-panel display device that does not cause deterioration of display quality such as partial decline of contrast. A signal line driving circuit of the flat-panel display device according to the present invention comprises a shift register, a shift control circuit, an OR gate, a buffer, and an analog switch. The shift register has a first register group and a second register group. The first register group shifts start pulses in order. The second register group shifts the output of the register at the last stage of the first register group in order. When the shift pulse is outputted from the register at the last stage of the second register group, all of the analog switches turns ON, and in synchronism with this timing, all of the video bus line are set at an intermediate voltage, thereby precharging all of the signal lines to the intermediate voltage during a blanking period.

35 Claims, 8 Drawing Sheets

FLAT-PANEL DISPLAY DEVICE, ARRAY SUBSTRATE, AND METHOD FOR DRIVING FLAT-PANEL DISPLAY DEVICE

BACKGROUND OF THE INVENTION

1. Field of the Invention

This invention relates to a method for driving signal lines of a flat-panel display, such as a liquid crystal display device, in which plural signal lines and scanning lines are arranged in a matrix form.

2. Related Background Art

Flat-panel display devices, such as active-matrix liquid crystal display devices employing thin film transistors (TFTs) are widely used as displays for computers etc., because of their high response speed and high resolution. As portable apparatus such as notebook-size computers become prevalent, driver integrated type of liquid crystal display devices, in which a liquid crystal display part and a driving circuit part are formed on a common substrate in the same process, attract someone's notice.

FIG. 1 is a block diagram schematically showing a structure of a signal line driving circuit of an driver integrated type of liquid crystal display device, which has a shift register 51 for sequentially shifting start pulses XST inputted from outside, buffers 41–4*n* each connected to corresponding output terminals of the shift register 51, and analog switches 5, ons and offs of which are controlled by output signals from the buffers 41–4*n*.

The signal line driving circuit of FIG. 1 carries out a so-called block sequence driving, in which a plurality of signal lines are simultaneously driven as a block. By such a block sequence driving, it is possible to lower the frequencies of shift clock signals XCK and /XCK of the shift register 51, thereby increasing the number of signal lines S1, S2, . . . , Sn. Accordingly, it is possible to improve display resolution.

FIG. 2 is a timing chart of input and output signals of the signal line driving circuit shown in FIG. 1. In FIG. 2, a V-line inversion driving is carried out.

The operations of the signal line driving circuit of FIG. 1 will be explained below with reference to FIG. 2. The shift clock signals XCK and /XCK are inputted to the shift register 51. The logic of XCK is inverted relative to that of /XCK. In FIG. 2, a start pulse XST is inputted at the time T11. The shift register 51 then starts the shift operation and each output terminal of the shift register 51 outputs the shift pulse in order.

A shift pulse is then outputted from an output terminal of the shift register 51 at the time T12, thereby turning ON an analog switch 5 connected to this output terminal. Accordingly, a voltage of a video bus line connected to the analog switch 5 is supplied to the corresponding signal line and the video bus line is charged. The analog switch 5 is then turned OFF at the time T13. The voltage charged in the signal line via the analog switch 5 just before the analog switch 5 is turned OFF is held in the signal line.

Currently, signal line driving methods include, besides the frame inversion driving method in which the polarity of voltage relative to a reference voltage is inverted frame by frame in order to avoid deterioration of liquid crystal display device, a V-line inversion driving method in which the polarity of voltage relative to the reference voltage is inverted by every signal line, and an H-line inversion driving method in which the polarity of voltage relative to the reference voltage is inverted by every one or more horizontal lines. The V-line driving method, and the H-line driving method are combined with the frame inversion driving method to lower the flicker.

FIG. 3 is a timing chart showing the timings of several devices of the signal line driving circuit of FIG. 1 when the H-line inversion driving is carried out. In descending order, the timings of control signals inputted to control terminals of the analog switches 5, the voltage level of the video bus lines L1–Lm, and the voltage level of the signal lines are shown. In FIG. 3, the voltage levels of the positive polarity side for displaying white is 5.5V and that for displaying black is 9.5V, and the voltage levels of the negative polarity side for displaying white are 4.5V and that for displaying black is 0.5V.

FIG. 3 shows that a black-level voltage is held from the time T11 till the next horizontal line period. The period from T12 to T13 is a horizontal blanking period. After the time T13, display of the next horizontal line is begun.

When the H-line inversion driving is carried out, for example, a polarity of the signal line voltage becomes larger or smaller than the reference voltage. Because of this, from the time T13 onward, the pixel voltage with negative polarity relative to the reference voltage is supplied to the video bus line. FIG. 3 shows an example in which two adjacent horizontal lines are set to voltages corresponding to black.

Thus, when the H-line inversion driving is carried out, the polarity of the signal line voltage should be inverted relative to the reference voltage at a predetermined timing in one frame period. Accordingly, the level of voltage supplied to signal lines via the bus line should be considerably changed. For example, when the voltage level of two adjacent horizontal lines is changed from that for black in the positive polarity to that of black in the negative polarity, the difference in voltage is:

$$9.5V-0.5V=9V.$$

However, in the block sequence driving shown in FIG. 1, as the period in which the analog switch 5 is on is only some hundreds nsec, it is very difficult to dramatically change the voltage level of the video bus lines and the signal lines during this period.

If the voltage level of two adjacent horizontal lines is changed from that for white in the positive polarity to that of white in the negative polarity, the difference in voltage is:

$$5.5V-4.5V=1.0V.$$

As this difference is quite lower than that of black level (9.0V), it is rather easy to change the voltage of the video bus lines and the signal lines.

As mentioned above, when the H-line inversion driving is carried out in a conventional liquid crystal display device, the polarity of voltage of signal lines should be changed by a predetermined number of horizontal lines. The closer to black a color is, the higher the difference in voltage level between the positive polarity and the negative polarity becomes. As a result, errors in writing to signal lines would easily occur for such a color, thereby causing display faults such as a contrast deterioration.

On the other hand, when the V-line inversion driving is carried out, because the polarity of voltage is never inverted by every single horizontal line, decline of contrast due to the write shortage of the signal line voltage by the above-mentioned polarity inversion does not occur. However, the horizontal line written just after the vertical blanking period is finished is supplied with a voltage, the polarity of which is inverted relative to that of a just previous horizontal line. Because of this, the closer to black a color is, the more likely the write shortage to the signal lines is. As a result, the display quality deteriorates. Specifically, the contrast becomes lower than the other horizontal scanning lines, or the thin blight lines occurs on the display region.

As a method for avoiding deterioration of display quality due to errors of signal line voltage, Japanese Patent Laid-Open Publication No. 6-20276 discloses a technique for precharging signal line capacitances during the blanking period in order to reduce the influence of change in voltage of signal lines on pixels.

FIG. 4 is a circuit diagram of a liquid crystal display device disclosed in the above-mentioned publication. The display shown in FIG. 4 has a signal line driving circuit 60 including a first register group 60*a* and a second register group 60*b*. In a blanking period, all of the TFTs 61 connected to signal lines S are turned ON by the first register group 60*a*, and all of the TFTs 62 are turned ON by a shift pulse outputted from the second register group 60*b*, thereby precharging each signal lines via reset signal lines 63.

However, the above-mentioned display device is intended to precharge the signal lines S, not the video bus. Therefore, when the load on the video bus is heavy, it takes a long time before the voltage of the video bus reaches a predetermined level. Accordingly, brightness of a pixel displayed just before the completion of the blanking period would be different from the brightness of other pixels.

Furthermore, as the reset signal lines for precharging the signal lines are necessary for the display shown in FIG. 4, the amount of wiring in the array substrate would increase.

SUMMARY OF THE INVENTION

An object of the present invention is to provide a flat-panel display device, an array substrate, a method for driving the flat-panel display device that does not cause deterioration of display quality, such as partial reduction in picture quality.

In order to achieve the foregoing object, a flat-panel display comprising:

an array substrate formed of an insulating substrate, including:

a plurality of pixel electrodes connected via switching elements to intersections of a plurality of signal lines and a plurality of scanning lines placed in a matrix form on said insulating substrate;

a signal line driving circuit, placed on said insulating substrate, for supplying analog image signals transmitted from an image control circuit to each of said signal lines; and a scanning line driving circuit, placed on said insulating substrate, for supplying scanning pulses to each of said scanning lines; and an opposed substrate placed opposite to said array substrate via an optical modulating layer, wherein said signal line driving circuit including:

a shift register having cascade-connected plural flip-flops;

at least one bus line for transmitting said analog image signals outputted from said image control circuit; and a plurality of analog switches, each connected between the corresponding signal line and the corresponding bus line, for supplying said analog image signals on the bus line to each of said signal lines, based on outputs of said flip-flops, wherein said image control circuit sets a voltage of the bus line at substantially an intermediate voltage between a maximum voltage and a minimum voltage of said analog image signals on the bus line in a predetermined precharge period in at least one of a horizontal blanking period or a vertical blanking period.

According to the present invention, for example, after the drive of a single signal lines has finished, a voltage of a video bus line is set at substantially an intermediate voltage of a peak-to-peak voltage of image signals. Because of this, undesirable problems such as decline of contrast due to a write shortage of the video bus line and occurrence of a thin bright line would be solved, thereby improving display quality.

Furthermore, when voltages of all the signal lines are set via the video bus line at the intermediate voltage of a peak-to-peak voltage of the image signals, it is possible to further improve display quality.

According to the present invention, a start pulse is provided for a signal line driving circuit in a horizontal blanking period, and a timing for setting voltages of all the signal lines at substantially an intermediate voltage of a peak-to-peak voltage on the signal lines is regulated by using the start pulse. Therefore, it is unnecessary to provide a circuit for setting the timing, and it is possible to simplify a circuit configuration.

Furthermore, a flat-panel display comprising:

a plurality of pixel electrodes connected via switching elements to intersections of a plurality of signal lines and a plurality of scanning lines placed in a matrix form on an insulating substrate;

a signal line driving circuit, placed on said insulating substrate, for supplying analog image signals from an image control circuit to each of said signal lines; and a scanning line driving circuit, placed on said insulating substrate, for supplying scanning pulses to each of said scanning lines, said signal line driving circuit including:

a shift register having cascade-connected plural flip-flops;

at least one bus line for transmitting said analog image signals outputted from said image control circuit; and a plurality of analog switches, each connected between the corresponding signal line and the corresponding bus line, for supplying said analog image signals on the bus line to each of said signal lines, based on outputs of said flip-flops, wherein said image control circuit sets a voltage on the bus line at substantially an intermediate voltage between a maximum voltage and a minimum voltage of said analog image signals in a predetermined precharge period in at least one of a horizontal blanking period or a vertical blanking period; and said signal line driving circuit brings the bus line and said analog switches by controlling said analog switches in accordance with said precharge period.

According to the present invention, without increasing the circuit configuration to a large extent, it is possible to solve undesirable problems such as decline of contrast and occurrence of thin blight lines, thereby improving the display quality.

DESCRIPTION OF THE PREFERRED EMBODIMENTS

Preferred embodiments of the present invention will be described below with reference to the drawings.

The liquid crystal display device according to the present invention has an array substrate and an opposed substrate. A liquid crystal layer is sandwiched between the array substrate and the opposed substrate, and sealed. On the array substrate, a pixel array part and a driving circuit part are integrally formed. In the pixel array part, signal lines and scanning lines are arranged on a glass substrate, for example, to form a display region. The driving circuit part includes a signal line driving circuit for driving the signal lines and a scanning line driving circuit for driving scanning lines.

First Embodiment

Figure 1:
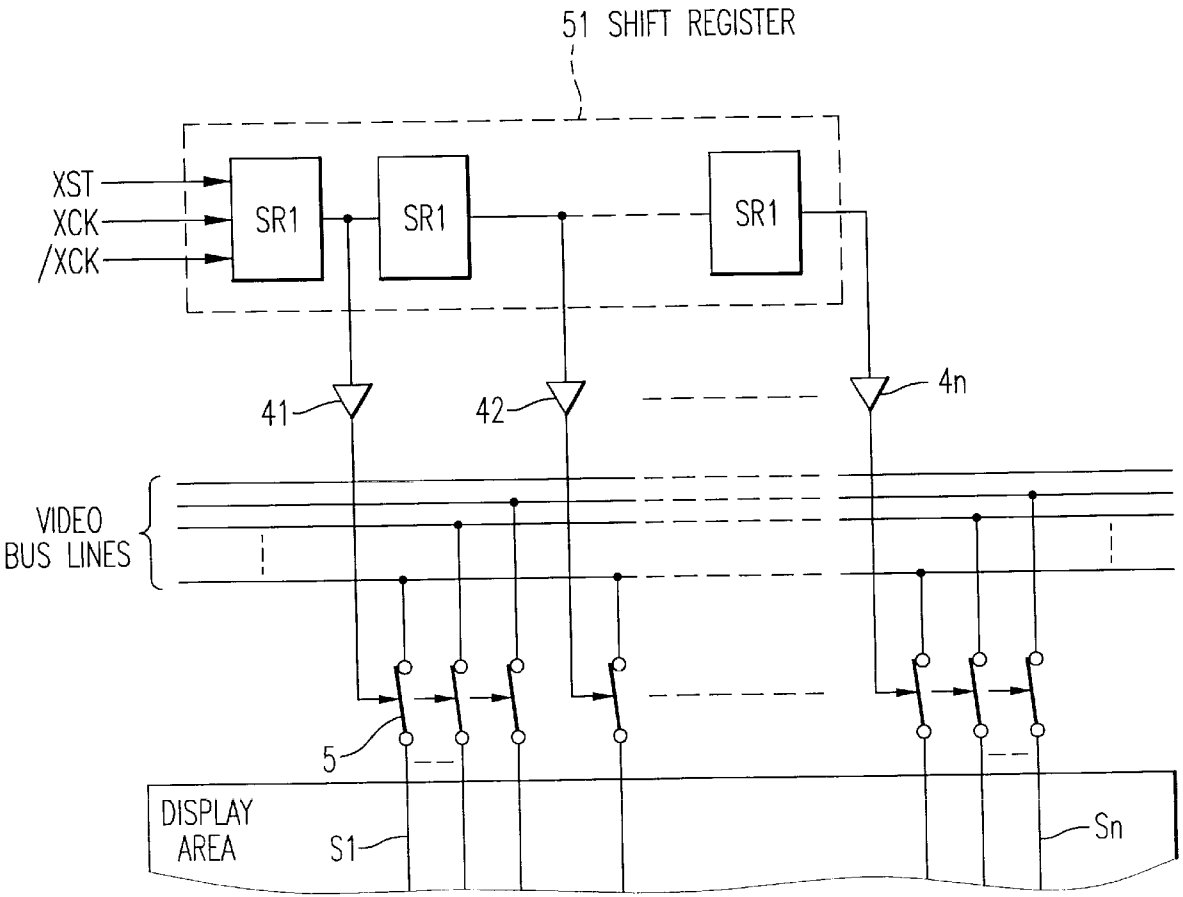
FIG. 1 is a block diagram of a signal line driving circuit of a conventional liquid crystal display device having a driving circuit.
Figure 2:
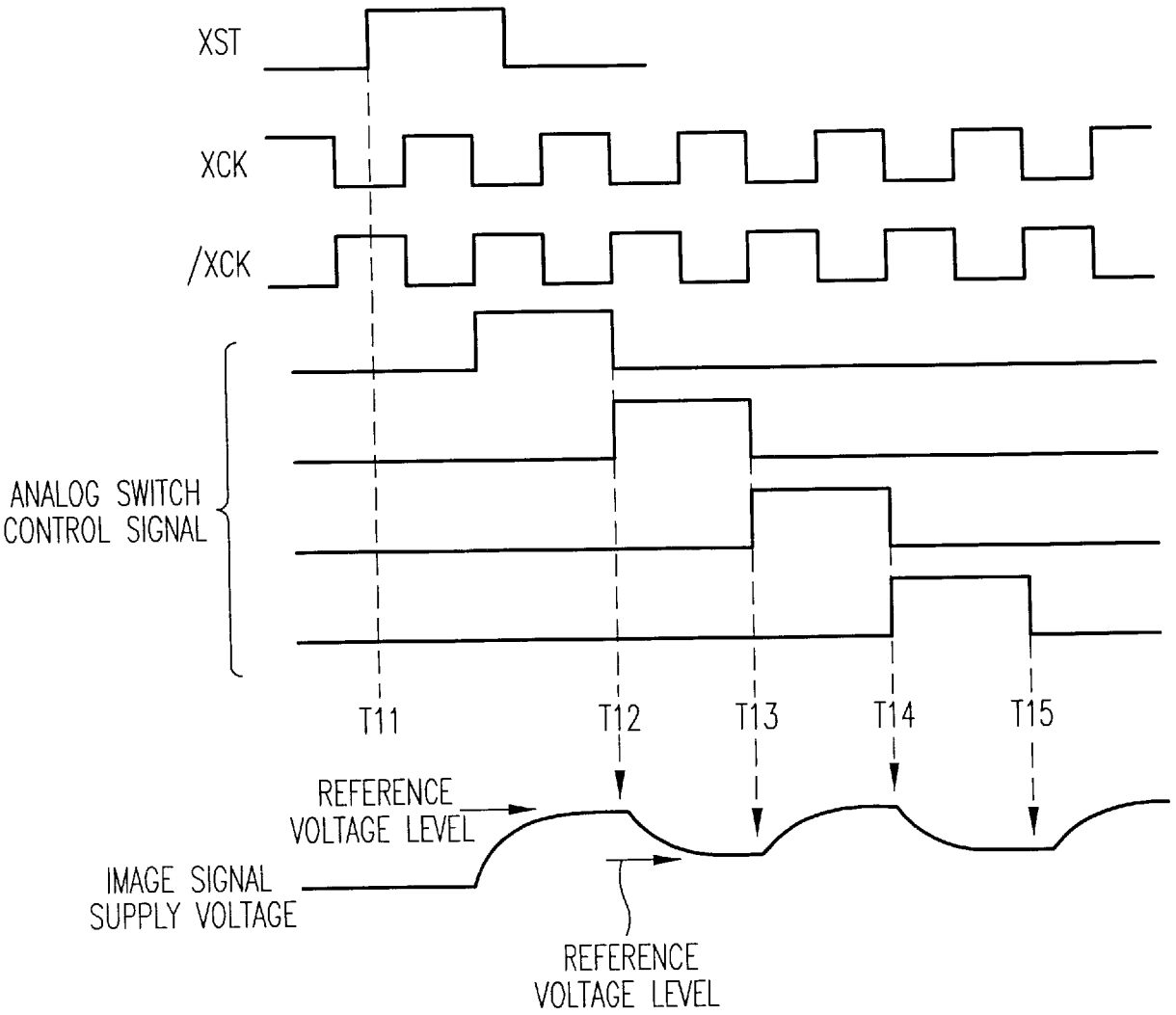
FIG. 2 is a timing chart of the input/output signals of the signal line driving circuit shown in FIG. 1.
Figure 3:
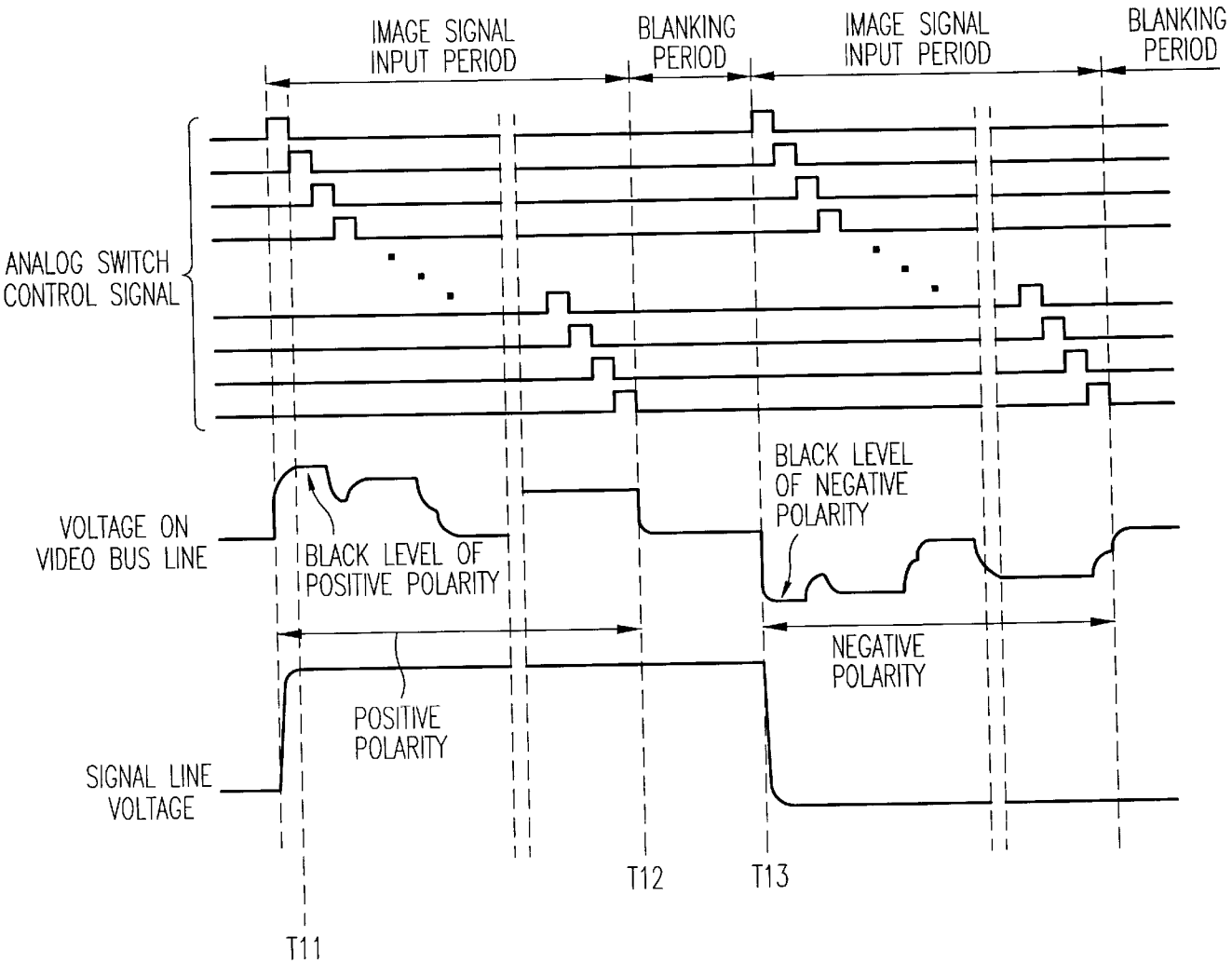
FIG. 3 is a timing chart of some parts of the signal line driving circuit shown in FIG. 1 when H-line inversion driving is carried out.
Figure 4:
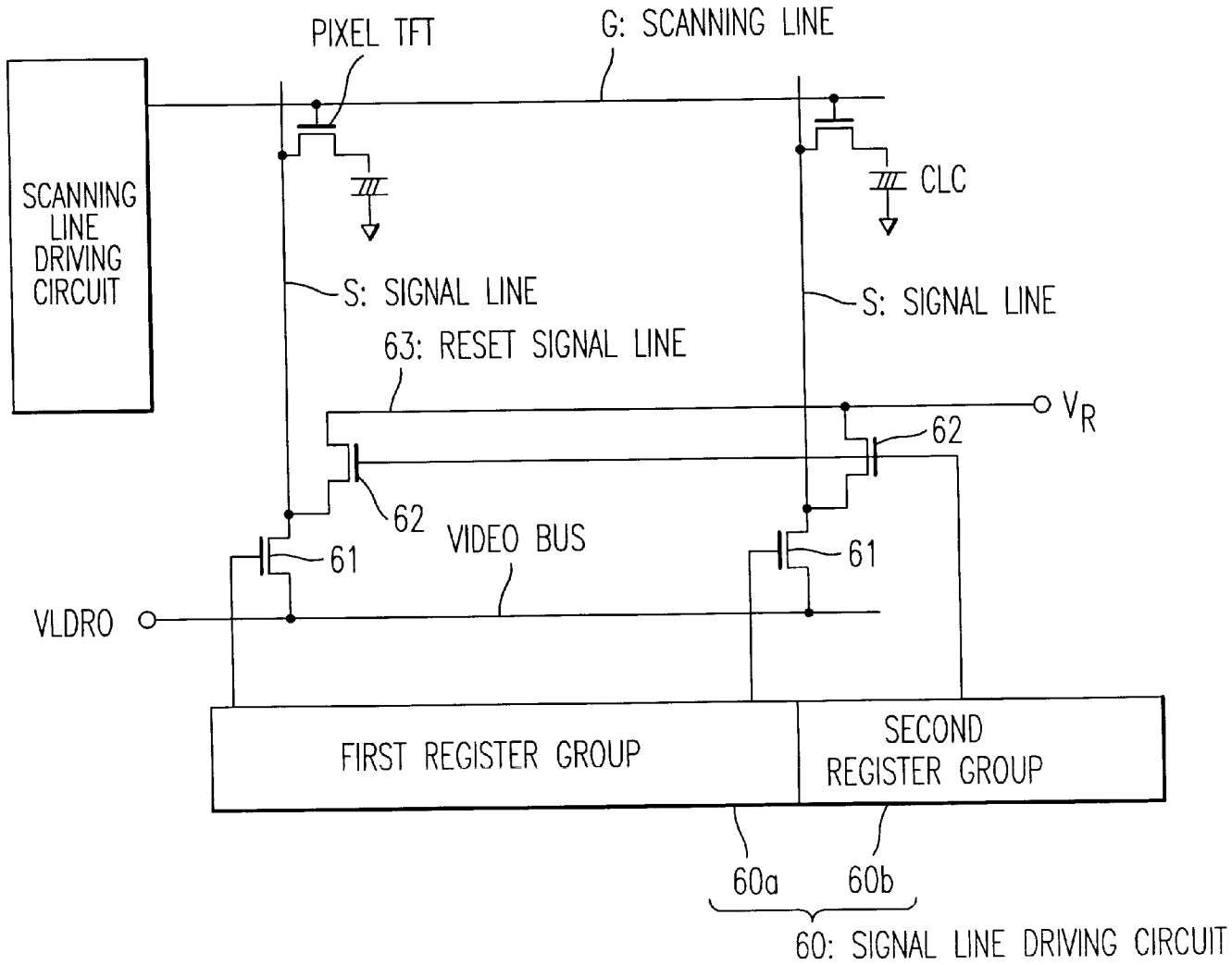
FIG. 4 is a circuit diagram of the liquid crystal display device disclosed in the above-mentioned publication.
Figure 5:
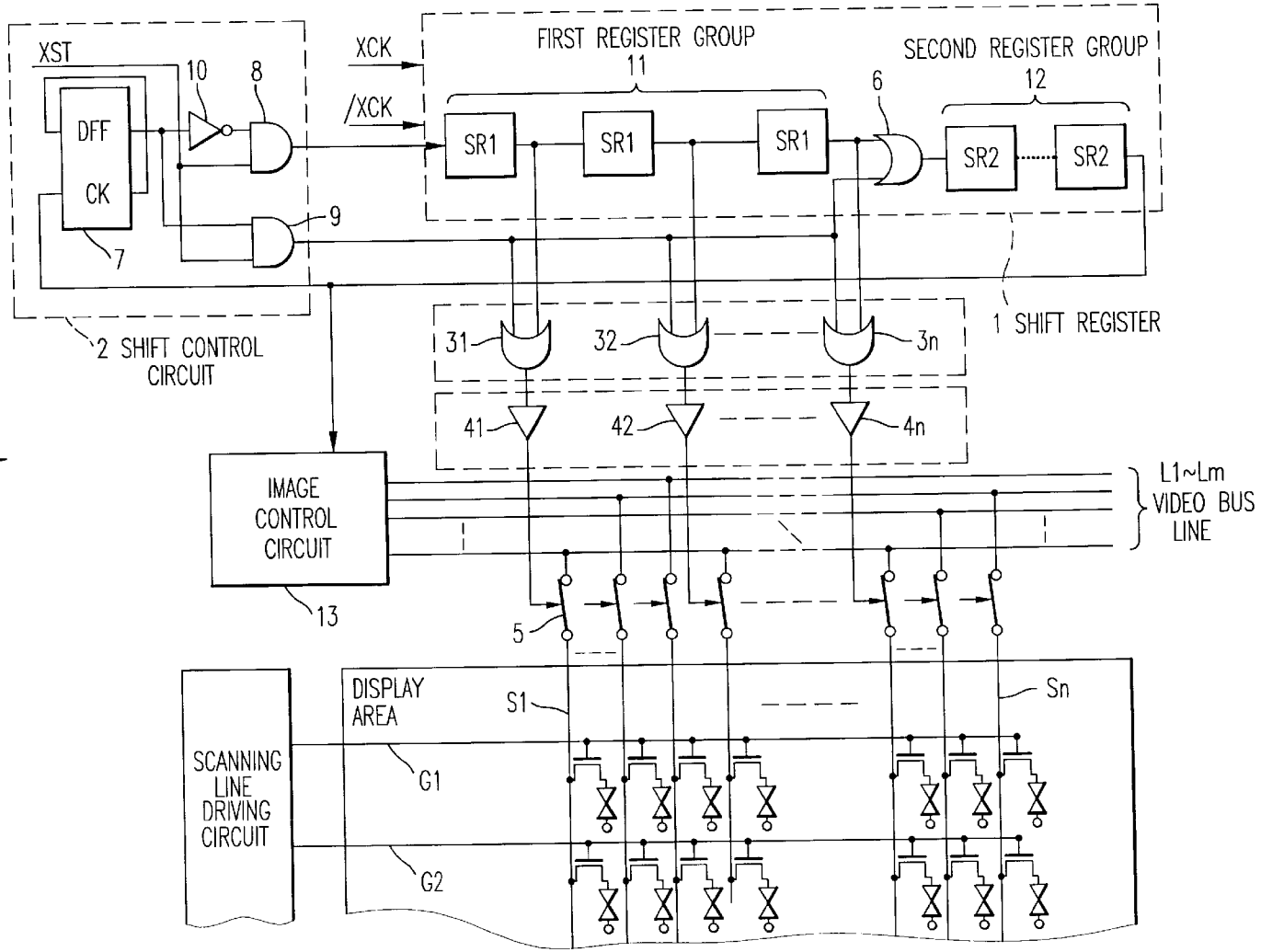
FIG. 5 is a block diagram schematically showing a structure of a signal line driving circuit of a liquid crystal display device according to the present invention.

FIG. 5 is a block diagram schematically showing a structure of a signal line driving circuit of a liquid crystal display device of the first embodiment according to the present invention. This signal line driving circuit simultaneously drives plural signal lines as a group (so-called block sequence driving). As a further method of driving signal lines, H-line inversion driving, in which the polarity of voltage relative to a reference voltage is inverted by every horizontal line, is employed.

The signal line driving circuit of FIG. 5 has a shift register 1 for transmitting shift pulses for driving signal lines S1–Sn arranged on the pixel array part, a shift control circuit 2 for controlling the shift register 1, a plurality of OR gates **31–3*n* each connected to a corresponding output terminal of the shift register 1, a plurality of buffers 41–4*n* each connected to a corresponding output terminal of the OR gates 31–3*n*, and a plurality of analog switches 5** for switching whether or not to supply the signal lines S1–Sn with analog pixel voltages of video bus lines L–Lm.

A plurality of the analog switches 5 constitute a group. The analog switches 5 in the same block are tuned on or off in the same timing by the outputs from the corresponding buffers **41–4*n*. Each end of the analog switches 5 at one side in each block is separately connected to the corresponding video bus lines, and each end of the analog switches 5** at the other side in the same block is separately connected to signal lines S1–Sn.

The shift register 1 has a first register group 11 in which a predetermined number of registers SR1, the number of which is decided in accordance with the number of the signal lines S1–Sn, are serially connected, an OR gate 6 connected to an output terminal of the register SR1 at the last stage of the first register group 11, and a second register group 12 connected to a subsequent stage of the OR gate 6 in which a predetermined number of register SR2.

The shift control circuit 2 has a D flip-flop (clock toggle means) 7, AND gates (first logical operation means) 8 and 9, and an inverter 10. Output signals from the register SR2 in the last stage of the second register group 12 of the shift register 1 is inputted to the clock terminal of the D flip-flop 7.

The D flip-flop 7 is reset at the time the power supply is turned ON, and a Q output terminal thereof is at a low level. When the output of the register SR2 at the last stage of the second register group 12 changes from a low level to a high level, the Q output terminal changes to a high level. When the Q output terminal is at the low level, the output of the AND gate 9 is fixed to a low level, and the AND gate 8 outputs a start pulse XST. On the other hand, when the Q output terminal is at the high level, the AND gate 9 outputs a start pulse XST, and the output of the AND gate 8 is fixed to a low level.

Each register SR1 of the first register group 11 sequentially shifts the start pulse XST outputted from the AND gate 8 of the shift control circuit 2 in synchronism with shift clocks XCK and /XCK that are a horizontal clock signal and the inverted clock signal thereof inputted from outside. Hereinafter, a pulse outputted from any of the registers SR1 is called a shift pulse.

When a shift pulse is outputted from the register SR1 at the last stage of the first register group 11, or a start pulse XST is outputted from the AND gate 9, the output of the OR gate 6 becomes a high level, thereby starting the shift operation of the second register group 12.

Each of the OR gates (second logical operation means) **31–3*n* connected to corresponding terminals of the registers SR1 of the first register group 11 outputs a logical OR signal obtained from an output signal from the corresponding register SR1 and an output signal from the AND gate 9 of the shift control circuit 2**.

The outputs of the OR gates **31–3*n* are transmitted, via the buffers 41–4*n*, to control terminals of the corresponding analog switches 5. The analog switches 5 in the same block are concurrently turned ON or OFF by the output of one buffer. Each of the analog switches 5 is separately connected to a corresponding video bus line. An image control circuit 13 is connected to these bus lines. The image control circuit 13** may be provided on either the array substrate or another substrate. In this embodiment, it is provided on another substrate.

AD/A converter, not shown, is provided within the image control circuit 13. This D/A converter converts digital pixel data outputted from a computer etc., not shown, to an analog pixel voltage, and supplies the voltage to the video bus lines L1–Lm of FIG. 5.

Figure 6:
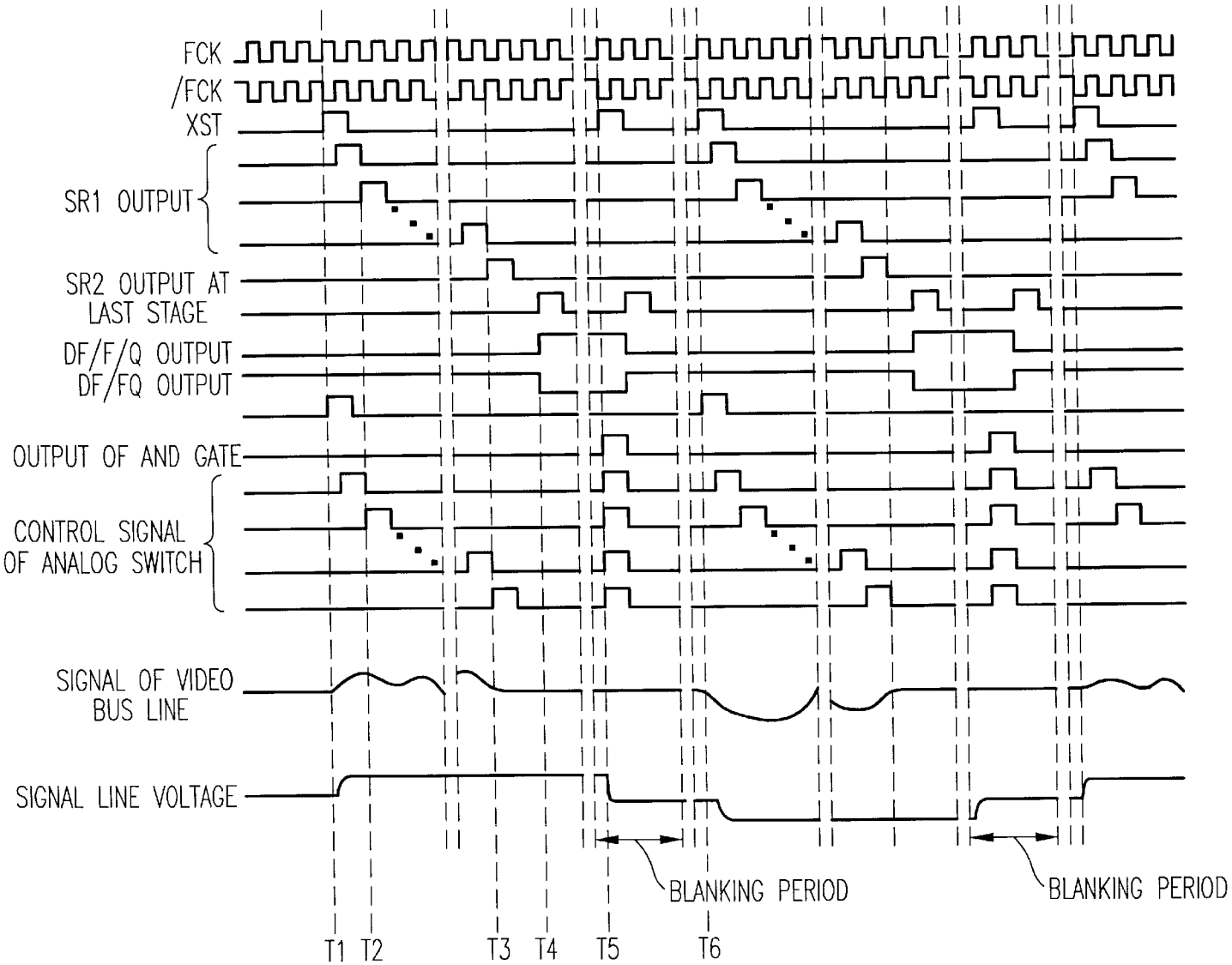
FIG. 6 is a timing chart showing the signal waveform of some parts of the signal line driving circuit shown in FIG. 1.

FIG. 6 is a timing chart showing the signal waveform of some parts of the liquid crystal display device shown in FIG. 5. In FIG. 6, in descending order, the waveforms of the shift clocks XCK and /XCK, the start pulse XST, the output of the registers SR1 of the first register group 11, the output of the register SR1 at the last stage of the second register group 12, the Q and /Q outputs of the D flip-flop 7, the output of the AND gate 8, the output of the AND gate 9, the control signal inputted to the control terminals of the analog switches 5, the signal on the video bus lines L1–Lm, and the signal line voltage are shown.

Hereinafter, the operation of the liquid crystal display device of FIG. 5 will be described with reference to FIG. 6. When the power supply is turned ON, the D flip-flop is reset. The Q output of the D flip-flop 7 becomes a low level, and the output of the inverter 10 becomes a high level. When a start pulse XST is inputted at the time T1, the start pulse XST is inputted, via the AND gate 8, to the register SR1 at the first stage of the first register group 11. At this time, the output of the AND gate 9 is at a low level.

Each of the registers SR1 of the first register group then sequentially outputs a shift pulse, which is obtained by shifting the start pulse XST, in synchronism with the shift clocks XCK and /XCK. The shift pulse outputted from the first register group 11 is outputted, via the OR gates 31–3*n* and the buffers 41–4*n*, to the control terminal of the corresponding analog switch 5. When the shift pulse is inputted to the control terminal, the analog switch 5 is turned ON, and provides an analog pixel voltage of the video bus lines L1–Lm to the corresponding signal line.

Through the above-mentioned operation, when a shift pulse is outputted from the first register group 11, at almost the same time, the corresponding analog switch 5 is turned ON, and an analog pixel voltage of the corresponding video bus line is provided to the signal line connected to this analog switch 5.

FIG. 6 shows the voltage waveform of the signal line connected to the analog switch 5 that is turned OFF at the time T2. As shown in this drawing, the level of voltage just before the analog switch 5 is turned OFF is maintained on this signal line.

At the time T3, the register SR1 of the last stage of the first register group 11 outputs a shift pulse, which is sent, via the OR gate 6, to the register SR2 at the first stage of the second register group 12. The second register group 12 then starts the shift operation. At the time T4, the register SR2 at the last stage of the second register group 12 outputs a shift pulse, which is sent to the clock terminal of the D flip-flop 7, thereby inverting the logics of the Q output and the /Q output. Accordingly, the output of the AND circuit 8 is fixed to a low level, and the output of the AND circuit 9 changes to a high level when a start pulse XST is inputted (at the time T5).

When the output of the AND circuit 9 changes to a high level, the output of all the OR gates 31–3*n* changes to a high level, and all the analog switches 5 are turned ON. In synchronism with this timing, the D/A converter, not shown, sets the voltage of all the video bus lines L1–Lm at the intermediate voltage of a peak-to-peak voltage. The term "intermediate voltage" means the voltage level at substantially the mid-point of the positive peak and the negative peak. Accordingly, all the video bus lines L1–Lm and all the signal lines S1–Sn are precharged at the intermediate voltage during a horizontal blanking period.

During the horizontal blanking period, the output of the AND circuit 9 is held at the high level only in the period the start pulse XST is inputted. After the horizontal blanking period is finished, at the time T6, a start pulse XST is inputted again, thereby resuming the shift operation of the first register group 11.

As mentioned above, in the first embodiment, all the video bus lines L1–Lm and all the signal lines S1–Sn are precharged at the intermediate voltage during a horizontal blanking period. Therefore, the change in voltage just after the horizontal blanking period is finished is rather small, and it is possible to set the voltage of the video bus lines L1–Lm and the signal lines S1–Sn at a predetermined level rapidly.

If the intermediate voltage is set to be 5V, as the maximum voltage of the video bus lines L1–Lm and the signal lines S1–Sn is 9.5V, it is only necessary to raise the voltage by 4.5V after the horizontal blanking period. As a result, the problem that the voltages of the video bus lines L1–Lm and the signal lines S1–Sn would not properly rise within a predetermined period would be solved, and the contrast irregularity would be restrained, thereby improving image quality.

Furthermore, in the first embodiment, the start pulse XST is outputted during a horizontal blanking period to regulate a timing for setting the voltages of all the video bus lines L1–Lm and all the signal lines S1–Sn to the intermediate voltage. Therefore, it is possible to simplify the circuit configuration for setting the timing.

Moreover, in the first embodiment, the signal lines S1–Sn are precharged via the video bus lines L1–Lm. Therefore, it is not necessary to have any extra bus line for precharging the signal lines, and it is possible to reduce the circuit size.

In the above descriptions, all the video bus lines L1–Lm transmit, in a predetermined cycle, an analog pixel voltage of the positive polarity side or the negative polarity side relative to the intermediate voltage of 5V. It is possible, however, to separate the video bus lines that transmit the analog pixel voltage of the positive polarity side (5.5–9.5V) from the video bus line that transmit the analog pixel voltage of the negative polarity side (0.5–4.5V).

In such a case, the video bus lines of the positive polarity side are precharged at 7.5V, which is the intermediate voltage of the analog pixel voltage-amplitude (5.5–9.5V) of the video bus lines, in a horizontal blanking period. On the other hand, the video bus lines of the negative polarity side are precharged at 2.5V, which is the intermediate voltage of the analog pixel voltage-amplitude (0.5–4.5V) of the video bus lines. The signal lines are supplied voltage from the video bus lines corresponding to the next written polarity. For example, before the video bus lines at the positive polarity side are selected, the signal lines are precharged at the intermediate voltage of 7.5V via the video bus lines of the positive polarity side. Accordingly, the change in voltage of the signal lines becomes rather small, and it is possible to set the voltage of the signal lines at a predetermined level rapidly.

Also in this case, it is not necessary to have extra bus lines for precharging the signal lines, thereby attaining a downsizing of the device.

Furthermore, if the video bus lines L1–Lm are separated into two groups, i.e., one group for transmitting the analog pixel voltage at the positive polarity side (5.5V–9.5V), and the other group for transmitting the analog pixel voltage at the negative polarity side (0.5V–4.5V), it is possible to precharge the video bus lines at the positive polarity side at 5.5V, which is substantially the intermediate voltage of the peak-to-peak voltage (0.5–9.5V), in a blanking period, and precharge the vide bus lines at the negative side at 4.5V, which is also substantially the intermediate voltage of the peak-to-peak voltage, thereby supplying the voltage from the video bus line corresponding to the next written polarity. For example, before the video bus lines at the positive polarity side are selected, the immediate voltage 5.5V is precharged to the signal lines capacitance via the video bus lines of the positive polarity side. Accordingly, the change in voltage of the signal lines becomes rather small, and it is possible to set the voltage of the signal lines at a predetermined level rapidly.

Second Embodiment

In a second embodiment according to the present invention, the analog switches are directly controlled by a shift pulse outputted from the register SR2 at the last stage of the second register group 12.

Figure 7:
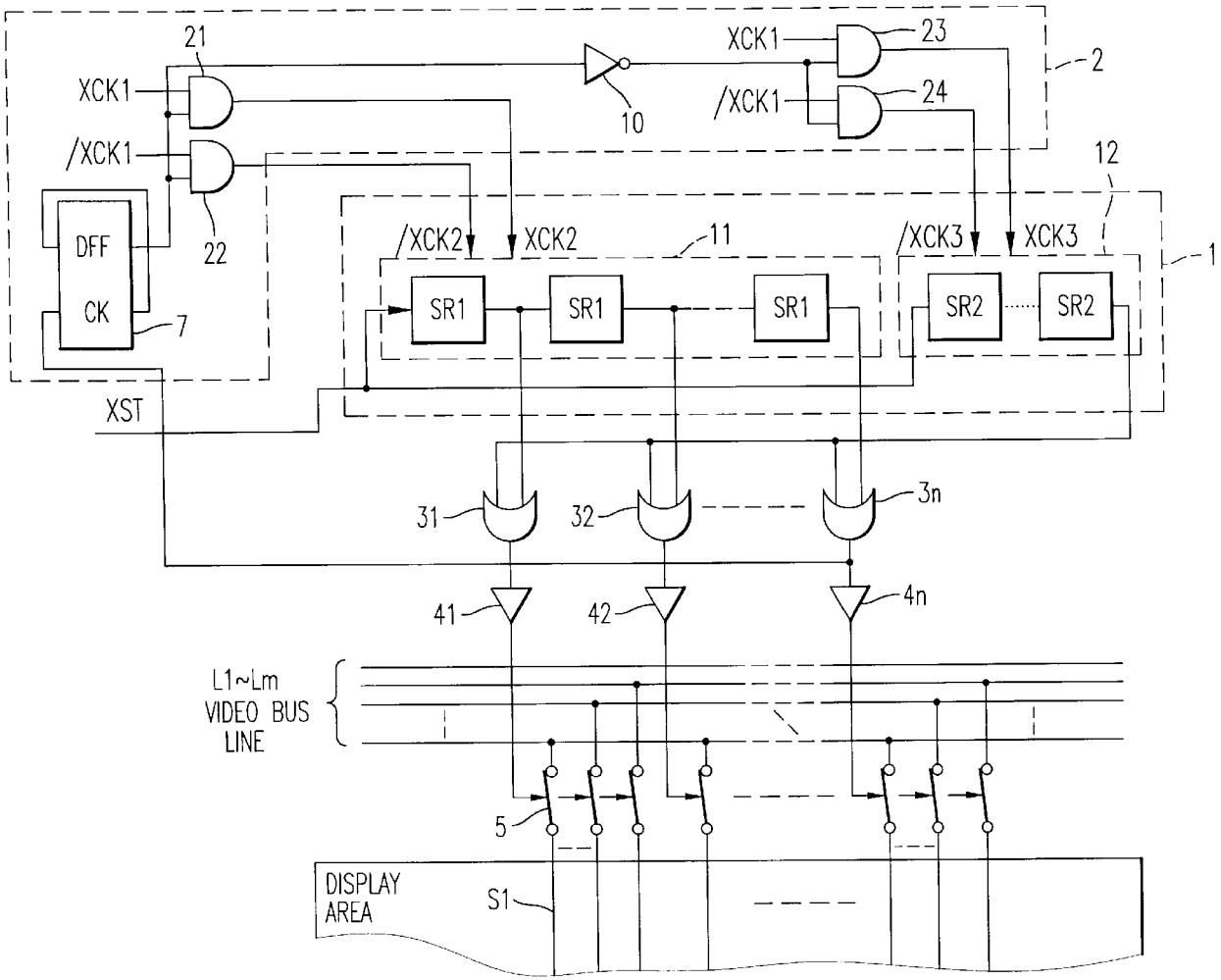
FIG. 7 is a block diagram schematically showing the structure of a second embodiment of the signal line driving circuit of a liquid crystal display device according to the present invention.

FIG. 7 is a block diagram schematically showing a structure of the second embodiment of the signal line driving circuit of a liquid crystal display device according to the present invention. In FIG. 7, the elements common to those of FIG. 5 are designated by the same reference numbers. Hereinafter, the differences between the first embodiment and the second embodiment will be described.

The structure of the signal line driving circuit shown in FIG. 7 is the same as that shown in FIG. 5, except for the shift register 1 and the shift control circuit 2. The flip-flop (clock toggle means) 7 and the AND gates (third logic calculation means) 21–24 correspond to the clock generating means, and the OR gates 31–3*n* correspond to the fourth logic calculation means.

The structure of the shift register 1 shown in FIG. 7 is the same as that in FIG. 5 in terms of having the first register group 11 and the second register group 12. However, the output of the first register group 11 is not transmitted to the second register group 12. Furthermore, there is no element corresponding to the OR gate 6 shown in FIG. 5. Separate groups of shift clocks (XCK2, /XCK2), (XCK3, /XCK3) are inputted to the first and second register groups 11 and 12, respectively.

The shift control circuit 2 shown in FIG. 7 has a D flip-flop 7 and AND gates 21–24, and an inverter 10. To a clock terminal of the D flip-flop 7, the output signal of the OR gate 3*n* connected to the register SR1 at the last stage of the first register group 11 is inputted.

The Q output of the D flip-flop 7 is inputted to the AND gates 21 and 22 and the inverter 10. If the Q output is at a high level, the AND gates 21 and 22 output the clocks XCK2 and /XCK2 which have the same logic as the clocks XCK1 and /XCK1 from outside.

Figure 8:
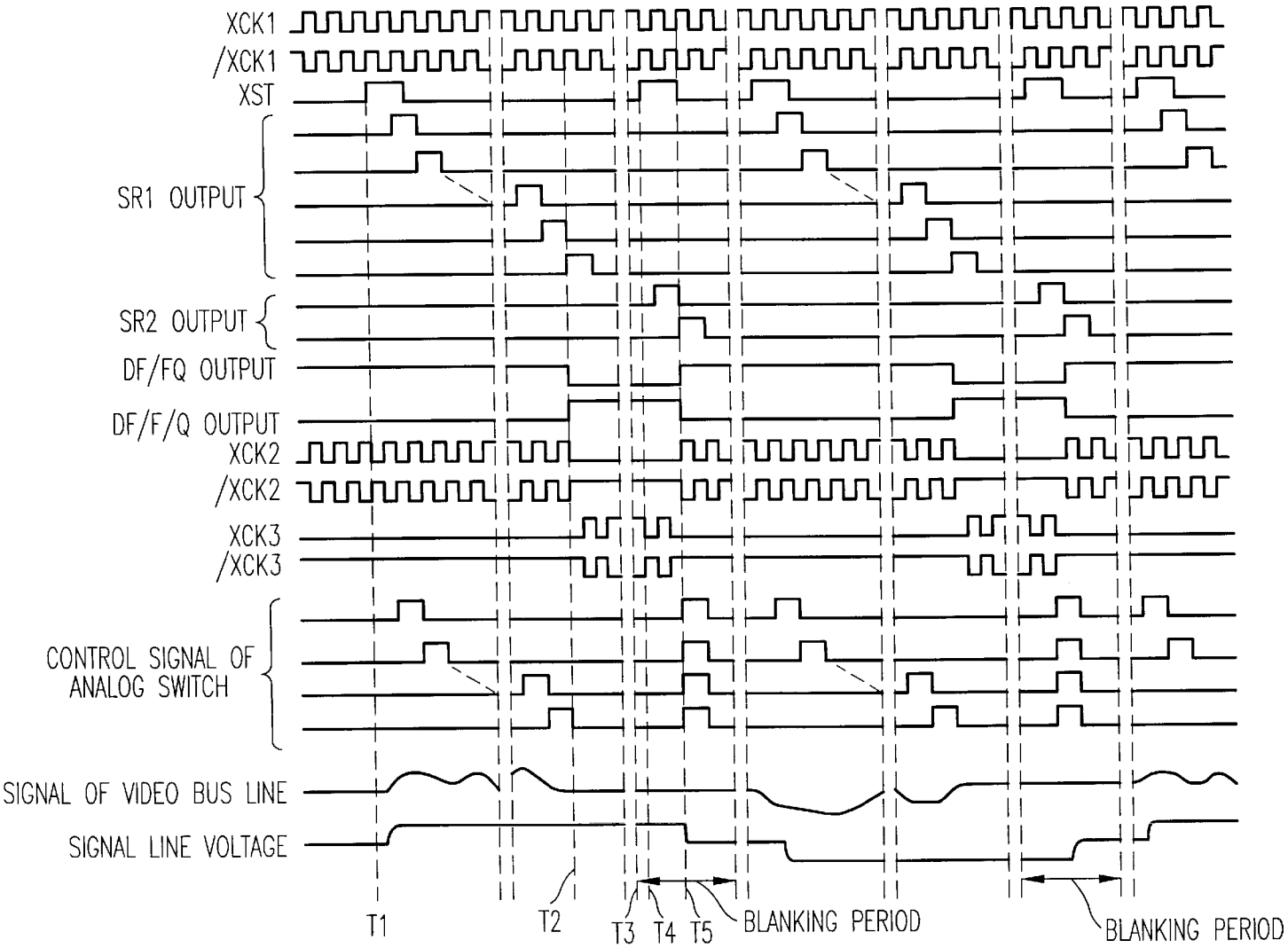
FIG. 8 is a timing chart showing the signal waveform of some parts of the signal line driving circuit shown in FIG. 7.

FIG. 8 is a timing chart showing the waveforms of some parts of the signal line driving circuit shown in FIG. 7. Hereinafter, the operation of the signal line driving circuit of FIG. 7 will be described with reference to this drawing.

When the power supply is turned ON, the D flip-flop 7 is set and the Q output terminal becomes a high level. At the time T1 of FIG. 8, a start pulse XST is inputted to both the first and second register groups 11 and 12. At this time, the Q output of the D flip-flop 7 is at a high level. The registers SR1 of the first register group 11 sequentially output a shift pulse in synchronism with the clocks XCK2 and /XCK2 outputted from the AND circuits 21 and 22.

The shift pulse from the first register group 11 is inputted, via the OR gates 31–3*n* and the buffers 41–4*n*, to a control terminal of the corresponding analog switch 5, thereby turning it ON. Accordingly, an analog pixel voltage of the corresponding video bus line L1–Lm is supplied to the corresponding signal line.

At the time T2 of FIG. 8, a shift pulse is outputted from the register SR1 at the last stage of the first register group 11, which is transmitted, via the OR gate 3*n*, to the clock terminal of the D flip-flop 7. Accordingly, the Q output of the D flip-flop is inverted, and the output terminals of the AND gates 21 and 22 become a low level.

At this time, the output of the inverter 10 becomes a high level, and the AND gates 23 and 24 output the clocks XCK3 and /XCK3, the logic of which is the same as that of the shift clocks XCK1 and /XCK1.

Then, at the time T3, a horizontal blanking period starts, and at the time T4, a start pulse XST is inputted. Accordingly, the second register group 12 sequentially shift the start pulse XST, thereby sequentially outputting a shift pulse having substantially the same pulse width as the start pulse XST.

At the time T5, a shift pulse is outputted from the register SR2 at the last stage of the second register group 12, by which all the OR gates 31–3*n* become a high level. Accordingly, all the analog switches 5 are turned ON. At this time, the D/A converter (not shown) sets all the video bus lines at the intermediate voltage level.

As mentioned above, as is the case with the first embodiment, in the second embodiment, all the video bus lines L1–Lm and all the signal lines S1–Sn are set at the intermediate voltage level in a horizontal blanking period. Accordingly, it is possible to rapidly set the voltage of the video bus lines L1–Lm and the signal lines S1–Sn substantially at a "black level" or "white level". Furthermore, as is the case with the first embodiment, in the second embodiment, a start pulse XST is inputted during a horizontal blanking period, thereby determining a timing for setting the voltage of the video bus lines L1–Lm and the signal lines S1–Sn at the intermediate voltage level. Accordingly, it is possible to simplify the circuit configuration.

It should be noted that in FIGS. 5 and 7, there is no limit to the number of the registers SR2 of the second register group 12. The number may be determined based on the input timings of the start pulse XST in a horizontal blanking period.

It should further be noted that there is no limit to the number of signal lines constituting a block in the above-mentioned block sequence driving method. Furthermore, the present invention can also apply to a method for driving signal lines one by one.

In the above-mentioned embodiments, a start pulse XST is inputted during a horizontal blanking period. In the case of the V-line inversion driving, a start pulse should be inputted during a vertical blanking period, and the voltage of all the video bus lines L1–Lm and the signal lines S1–Sn should be set at the intermediate voltage level in synchronism with this start pulse XST. In other words, the timing for precharging of the video bus lines and signal lines depends on the driving method employed; that is, the precharging may be carried out in a horizontal blanking period, in a vertical blanking period, or in both the horizontal and vertical blanking periods.

Although the present invention is applied to a liquid crystal display device in the above-mentioned embodiments, it is also possible to apply the present invention to an electroluminescence (EL) display device, or a plasma display panel (PDP).

What is claimed is:

1. A flat-panel display comprising:

an array substrate formed of an insulating substrate, including:

a plurality of pixel electrodes connected via switching elements to intersections of a plurality of signal lines and a plurality of scanning lines placed in a matrix form on said insulating substrate;

a signal line driving circuit, placed on said insulating substrate, for supplying analog image signals transmitted from an image control circuit to each of said signal lines; and a scanning line driving circuit, placed on said insulating substrate, for supplying scanning pulses to each of said scanning lines; and an opposed substrate placed opposite to said array substrate via an optical modulating layer, wherein said signal line driving circuit includes:

a shift register having cascade-connected plural flip-flops;

at least one bus line for transmitting said analog image signals outputted from said image control circuit;

a shift control circuit for controlling said shift register, and a plurality of analog switches, each connected between the corresponding signal line and the corresponding bus line, for supplying said analog image signals on the bus line to each of said signal lines, based on outputs of said flip-flops, wherein said image control circuit sets a voltage of the bus line at substantially an intermediate voltage between a maximum voltage and a minimum voltage of said analog image signals on the bus line in a predetermined precharge period in at least one of a horizontal blanking period or a vertical blanking period.

2. A flat-panel display according to claim 1, wherein said shift register turns ON all of said analog switches in said precharge period.

3. A flat-panel display according to claim 2, wherein said shift register sets a timing for turning ON all of said analog switches, based on a start pulse inputted in at least one of the horizontal blanking period and the vertical blanking period.

4. A flat-panel display according to claim 3, wherein said shift register includes:

a first register having a plurality of flip-flops, for turning ON or OFF the corresponding one or more analog switches based on the outputs of the flip-flops; and a second register having one or more flip-flops, for generating a timing signal for setting a timing to turn ON all of said analog switches, based on the output of a last stage flip-flop of said first register.

5. A flat-panel display according to claim 4, wherein n (which is an integer larger than 1) pieces of said analog switches are provided in accordance with the output of each flip-flop of said first register, and each of said analog switches is connected to each of n pieces of bus lines.

6. A flat-panel display according to claim 4, wherein the flop-flops of the first and second registers carry out a shift operation based on a shift clock having the same frequency and the same phase, and the flip-flops of said second register sequentially shift the output of the flip-flop at the last stage of the first register in synchronism with said shift clock.

7. A flat-panel display according to claim 6, further comprising input control means for inputting the shift pulse outputted from the flip-flop at the last stage of the first register and the start pulse inputted in at least one of the horizontal blanking period and the vertical blanking period, to the flip-flop at the first stage of the second register.

8. A flat-panel display according to claim 4, further comprising:

a plurality of second logic calculation means, each provided for each of the flip-flops of said first register, for controlling turning ON or OFF of the corresponding analog switches, based on the output of the corresponding flip-flops, wherein said shift control circuit further comprises:

clock toggle means, the output logic of which is inverted when the shift pulse is outputted from the flip-flop at the last stage of the second register; and first logic calculation means for switching whether or not to supply the start pulse to the flip-flop of the first stage of said first register, based on the output of said clock toggle means;

wherein said first logic calculation means allows a supply of the start pulse to the flip-flop at the first stage of said first register in a period after a horizontal line period starts and before the output logic of said clock toggle means is inverted, wherein each of said second logic calculation means controls turning ON and OFF of the corresponding analog switches based on the output of the corresponding flip-flops of said first register in a period after a horizontal line period starts and before a first shift pulse is outputted from the flip-flop at the last stage of said second register, and turns ON all of said analog switches in a period after the first shift pulse is outputted from the flip-flop at the last stage of said second register and before a second shift pulse is outputted.

9. A flat-panel display according to claim 8, wherein when the start pulse is inputted in at least one of said horizontal blanking period and said vertical blanking period, said first logic calculation means supply the start pulse to the input terminal of the flip-flop at the first stage of said second register, without supplying it to said first register.

10. A flat panel display according to claim 4, wherein said shift control circuit further comprises clock generating means for generating a first shift clock to be supplied to a clock terminal of each of the flip-flops of said first register and a second shift clock to be supplied to the clock terminal of each of the flip-flops of said second register, said clock generating means outputting only said first shift clock in a period after a reset period finishes and before the flip-flop at the last stage of said first register outputs the shift pulse, without outputting said second shift clock, and outputting only said second shift clock in a period after the flip-flop at the last stage of said first register outputs the shift pulse and before the flip-flop at the last stage of said second register outputs the shift pulse, without outputting said first shift clock;

the flip-flops of said first register sequentially shift the start pulse in synchronism with said first shift clock; and the flip-flops of said second register sequentially shift said start pulse in synchronism with said second shift clock.

11. A flat-panel display according to claim 10, wherein said clock generating means further comprises:

a clock toggle means, the output logic of which is inverted when the shift pulse is outputted from the flip-flop at the last stage of said first register; and a third logic calculation means for generating said first and second shift clocks, based on the output of said clock toggle means and a clock signal inputted from outside.

12. A flat-panel display according to claim 11 further comprising:

a plurality of fourth logic calculation means, each provided for each of the flip-flops of said first register, for controlling turning ON and OFF of the corresponding analog switches, based on the output of the corresponding flip-flops;

wherein said fourth logic calculation means turn ON the corresponding analog switch when a shift pulse is outputted from the flip-flops of said first register in a horizontal line period, and turn ON all of the analog switches when a shift pulse is outputted from the flip-flop at the last stage of said second register in at least one of said horizontal blanking period and said vertical blanking period.

13. A flat-panel display according to claim 1, wherein said image control circuit is provided separately from said array substrate and said opposed substrate.

14. An array substrate comprising:

a plurality of pixel electrodes connected via switching elements to intersections of a plurality of signal lines and a plurality of scanning lines placed in a matrix form on an insulating substrate;

a signal line driving circuit, placed on said insulating substrate, for supplying analog image signals from an image control circuit to each of said signal lines; and a scanning line driving circuit, placed on said insulating substrate, for supplying scanning pulses to each of said scanning lines, said signal line driving circuit including:

a shift register having cascade-connected plural flip-flops;

at least one bus line for transmitting said analog image signals outputted from said image control circuit;

a shift control circuit for controlling said shift register; and a plurality of analog switches, each connected between the corresponding signal line and the corresponding bus line, for supplying said analog image signals on the bus line to each of said signal lines, based on outputs of said flip-flops, wherein said image control circuit sets a voltage on the bus line at substantially an intermediate voltage between a maximum voltage and a minimum voltage of said analog image signals of the corresponding signal line in a predetermined precharge period in at least one of a horizontal blanking period or a vertical blanking period.

15. A method for driving a flat-panel display device comprising an array substrate formed of an insulating substrate and an opposed substrate placed opposite to said array substrate via an optical modulating layer, said array substrate including:

a plurality of pixel electrodes connected via switching elements to intersections of a plurality of signal lines and a plurality of scanning lines placed in a matrix form, a signal line driving circuit for supplying analog image signals from an image control circuit to each of said signal lines; and a scanning line driving circuit for supplying scanning pulses to each of said scanning lines;

wherein at least one bus line for transmitting said analog image signals from said image control circuit is connected via a corresponding analog switch to each of said signal lines;

said image control circuit sets a voltage on the bus line at substantially an intermediate voltage between a maximum voltage and a minimum voltage of said analog image signals of the corresponding bus line in a predetermined precharge period in at least one of a horizontal blanking period or a vertical blanking period; and said precharge period is prescribed based on the output of said signal line driving circuit.

16. A flat-panel display comprising:

a plurality of pixel electrodes connected via switching elements to intersections of a plurality of signal lines and a plurality of scanning lines placed in a matrix form on an insulating substrate;

a signal line driving circuit, placed on said insulating substrate, for supplying analog image signals from an image control circuit to each of said signal lines; and a scanning line driving circuit, placed on said insulating substrate, for supplying scanning pulses to each of said scanning lines, said signal line driving circuit including:

a shift register having cascade-connected plural flip-flops;

at least one bus line for transmitting said analog image signals outputted from said image control circuit;

a shift control circuit for controlling said shift register; and a plurality of analog switches, each connected between the corresponding signal line and the corresponding bus line, for supplying said analog image signals on the bus line to each of said signal lines, based on outputs of said flip-flops, wherein said image control circuit sets a voltage on the bus line at substantially an intermediate voltage between a maximum voltage and a minimum voltage of said analog image signals in a predetermined precharge period in at least one of a horizontal blanking period or a vertical blanking period; and said signal line driving circuit brings the bus line and said analog switches into conduction by controlling said analog switches in said precharge period.

17. The flat-panel display device according to claim 16, wherein said shift register turns ON all of said analog switches in said precharge period.

18. The flat-panel display device according to claim 17, wherein said shift register sets a timing for turning ON all of said analog switches, based on the start pulse inputted in at least one of said horizontal blanking period or said vertical blanking period.

19. The flat-panel display device according to claim 18, wherein said shift register further includes:

a first register having a plurality of flip-flops, for turning ON or OFF the corresponding one or more analog switches, based on the outputs of the flip-flops; and a second register having one or more flip-flops, for generating a timing signal for setting a timing to turn ON all of said analog switches, based on the output of last stage flip-flop of said first register.

20. The flat-panel display device according to claim 19, wherein n (which is an integer larger than 1) pieces of said analog switches are provided in accordance with the output of each flip-flop of said first register, and each of said analog switches is connected to each of n pieces of the bus line.

21. The flat-panel display device according to claim 19, wherein each flip-flop of said first and second registers carry out a shift operation based on a shift clock having the same frequency and the same phase, and each flip-flop of said second register sequentially shift the output of the flip-flop at the last stage of the first register in synchronism with said shift clock.

22. The flat-panel display device according to claim 21, comprising:

input control means for inputting the shift pulse outputted from the flip-flop at the last stage of said first resister and said start pulse inputted in at least one of said horizontal blanking period and said vertical blanking period, to the flip-flop at the first stage of said second register.

23. The flat-panel display device according to claim 19, further comprising a plurality of second logic calculation means, each provided for each of the flip-flops of said first register, wherein said shift control circuit further comprises:

clock toggle means, the output logic of which is inverted when the shift pulse is outputted from the flip-flop at the last stage of said second register; and first logic calculation means for switching whether or not to supply said start pulse to the flip-flop at the first stage of said first register;

wherein said first logic calculation means allows a supply of the start pulse to the flip-flop at the first stage of said first register in a period after a horizontal line period starts and before the output logic of said clock toggle means is inverted; and wherein each of said second logic calculation means controls turning ON and OFF of the corresponding analog switches based on the output of the corresponding flip-flops of said first register in a period after a horizontal line period starts and before a first shift pulse is outputted from the flip-flop at the last stage of said second register, and turns ON all of said analog switches in a period after the first shift pulse is outputted from the flip-flop at the last of said second register and before a second shift pulse is outputted.

24. A flat-panel display according to claim 19, wherein when the start pulse is inputted in at least one of said horizontal blanking period and said vertical blanking period, said first logic calculation means supply the start pulse to the input terminal of the flip-flop at the first stage of said second register, without supplying it to said first register.

25. A flat panel display according to claim 19, wherein said shift control circuit comprises a clock generating means for generating a first shift clock to be supplied to a clock terminal of each of the flip-flops of said first register and a second shift clock to be supplied to the clock terminal of each of the flip-flops of said second register, said clock generating means outputting only said first shift clock in a period after a reset period finishes and before the flip-flop at the last stage of said first register outputs the shift pulse, without outputting said second shift clock, and outputting only said second shift clock in a period after the flip-flop at the last stage of said first register outputs the shift pulse and before the flip-flop at the last stage of said second register outputs the shift pulse, without outputting said first shift clock;

the flip-flops of said first register sequentially shift the start pulse in synchronism with said first shift clock; and the flip-flops of said second register sequentially shift the start pulse in synchronism with said second shift clock.

26. A flat-panel display according to claim 25, wherein said clock generating means further comprises:

a clock toggle means, the output logic of which is inverted when the shift pulse is outputted from the flip-flop at the last stage of said first register; and a third logic calculation means for generating said first and second shift clocks, based on the output of said clock toggle means and a clock signal inputted from outside.

27. A flat-panel display according to claim 26 further comprising:

a plurality of fourth logic calculation means, each provided for each of the flip-flops of said first register, for controlling turning ON and OFF of the corresponding analog switches, based on the output of the corresponding flip-flops;

wherein said fourth logic calculation means turn ON the corresponding analog switch when a shift pulse is outputted from the flip-flops of said first register in a horizontal line period, and turn ON all of the analog switches when a shift pulse is outputted from the flip-flop at the last stage of said second register in at least one of said horizontal blanking period and said vertical blanking period.

28. An array substrate, comprising:

pixel electrodes connected via switching elements to intersections of a plurality of signal lines and scanning lines placed in a matrix form;

a signal line driving circuit for supplying analog image signals with positive and negative polarities for a reference potential to each of said signal lines from an image control circuit; and a scanning line driving circuit for supplying scanning pulses to each of said scanning lines, said pixel electrodes, said signal line driving circuit and said scanning line driving circuit being formed on an insulating substrate, wherein said signal line driving circuit further comprises:

a shift register in which a plurality of flip-flops are connected in cascade;

a first bus line for transferring the analog image signal with positive polarity supplied from said image control circuit;

a second bus line for transferring the analog image signal with negative polarity supplied from said image control circuit; and analog switches for supplying to each of said signal lines the analog image signals with positive and negative polarities on said first and second bus lines, based on each output of said flip-flops, said analog switches being connected to each of said signal lines, said first bus line and said second bus lines, respectively, wherein said image control circuit sets a prescribed period within at least one of said horizontal and vertical blanking periods as a precharge period;

the voltage on said first bus line is set at substantially an intermediate voltage between a reference voltage and a maximum voltage of said analog image signal; and the voltage on said second bus line is set at substantially an intermediate voltage between a reference voltage and a minimum voltage of said analog image signal.

29. The array substrate according to claim 28, further comprising:

a shift control circuit for controlling said shift register, said shift register and said shift control circuit being formed on said insulating substrate.

30. The array substrate according to claim 28, further comprising:

a shift control circuit for controlling said shift register, said shift register and said shift control circuit being formed on substantially one insulating substrate.

31. A flat-panel display comprising:

an array substrate formed of an insulating substrate, including:

a plurality of pixel electrodes connected via switching elements to intersections of a plurality of signal lines and a plurality of scanning lines placed in a matrix form on said insulating substrate;

a signal line driving circuit, placed on said insulating substrate, for supplying analog image signals transmitted form an image control circuit to each of said signal lines; and a scanning line driving circuit, placed on said insulating substrate, for supplying scanning pulses to each of said scanning lines; and an opposed substrate placed opposite to said array substrate via an optical modulating layer, wherein said signal line driving circuit includes:

a shift register having cascade-connected plural flip-flops;

at least one bus line for transmitting said analog image signals outputted from said image control circuit; and a plurality of analog switches, each connected between the corresponding signal line and the corresponding bus line, for supplying said analog image signals on the bus line to each of said signal lines, based on outputs of said flip-flops, wherein said image control circuit sets a voltage of the bus line at substantially an intermediate voltage between a maximum voltage and a minimum voltage of said analog image signals on the bus line in a predetermined precharge period in at least one of a horizontal blanking period or a vertical blanking period, wherein said shift register turns ON all of said analog switches in said precharge period, wherein said shift register sets a timing for turning ON all of said analog switches, based on a start pulse inputted in at least one of the horizontal blanking period and the vertical blanking period, wherein said shift register further includes:

a first register having a plurality of flip-flops, for turning ON or OFF the corresponding one or more analog switches based on the outputs of the flip-flops; and a second register having one or more flip-flops, for generating a timing signal for setting a timing to turn ON all of said analog switches, and wherein said flat-panel display further comprises:

clock toggle means, the output logic of which is inverted when the shift pulse is outputted from the flip-flop at the last stage of the second register;

first logic calculation means for switching whether or not to supply the start pulse to the flip-flop of the first stage of said first register, based on the output of said clock toggle means; and a plurality of second logic calculation means, each provided for each of the flip-flops of said register, for controlling turning ON or OFF the corresponding analog switches, based on the output of the corresponding flip-flops, wherein said first logic calculation means allows a supply of the start pulse to the flip-flop at the first stage of said first register in a period after a horizontal line period starts and before the output of said toggle means is inverted, wherein each of said second logic calculation means controls turning ON and OFF the corresponding analog switches based on the output of the corresponding flip-flops of said first register in a period after a horizontal line period starts and before a first shift pulse is outputted form the flip-flop at the last stage of said second register, and turns ON all of said analog switches in a period after the first shift pulse is outputted from the flip-flop, but the last stage of said second register and before a second shift pulse is outputted.

32. A flat-panel display according to claim 31, wherein when the start pulse is inputted in at least one of said horizontal blanking period and said vertical blanking period, said first logic calculation means supply the start pulse to the input terminal of the flip-flop at the first stage of said second register, without supplying it to said first register.

33. A flat-panel display comprising:

a plurality of pixel electrodes connected via switching elements to intersections of a plurality of signal lines and a plurality of scanning lines placed in a matrix form on an insulating substrate;

a signal line driving circuit, placed on said insulating substrate, for supplying analog image signals from an image control circuit to each of said signal lines; and a scanning line driving circuit, placed on said insulating substrate, for supplying scanning pulses to each of said scanning lines, wherein said signal line driving circuit includes:

a shift register having cascade-connected plural flip-flops;

at least one bus line for transmitting said analog image signals outputted from said image control circuit; and a plurality of analog switches, each connected between the corresponding signal line and the corresponding bus line, for supplying said analog image signals on the bus line to each of said signal lines, based on outputs of said flip-flops, wherein said image control circuit sets a voltage on the bus line at substantially an intermediate voltage between a maximum voltage and a minimum voltage of said analog image signals in a predetermined precharge period in at least one of a horizontal blanking period or a vertical blanking period, wherein said signal line driving circuit brings the bus line and said analog switches into conduction by controlling said analog switches in said precharge period, wherein said shift register turns ON all of said analog switches in said precharge period, wherein said shift register sets a timing for turning ON all of said analog switches, based on the start pulse inputted in a least one of said horizontal blanking period, or said vertical blanking period, wherein said shift register further includes:

a first register having a plurality of flip-flops, for turning ON or OFF the corresponding one or more analog switches, based on the outputs of the flip-flops; and a second register having one or more flip-flops, for generating a timing signal for setting a timing to turn ON all of said analog switches, wherein said flat-panel display device further comprises:
clock toggle means, the output logic of which is inverted when the shift pulse if outputted from the flip-flop at the last stage of said second register;
first logic calculation means for switching whether or not to supply said start pulse to the flip-flop at the first stage of said first register; and
a plurality of second logic calculation means, each provided for each of the flip-flops of said first register, wherein said first logic calculation means allows a supply of the start pulse to the flip-flop at the first stage of said first register in a period after a horizontal line period starts and before the output logic of said clock toggle means is inverted, and wherein each of said second logic calculation means controls turning ON and OFF the corresponding analog switches based on the output of the corresponding flip-flops of said first register in a period after a horizontal line period starts and before a first shift pulse is outputted from the flip-flop at the last stage of said second register, and turns ON all of said analog switches in a period after the first shift pulse is outputted from the flip-flop at the last stage of said second register and before a second shift pulse is outputted.

34. A flat-panel display comprising:

a plurality of pixel electrodes connected via switching elements to intersections of a plurality of signal lines and a plurality of scanning lines placed in a matrix form on an insulating substrate;

a signal line driving circuit, placed on said insulating substrate, for supplying analog image signals from an image control circuit to each of said signal lines; and a scanning line driving circuit, placed on said insulating substrate, for supplying scanning pulses to each of said scanning lines, wherein said signal line driving circuit includes:
a shift register having cascade-connected plural flip-flops;
at least one bus line for transmitting said analog image signals outputted from said image control circuit; and
a plurality of analog switches, each connected between the corresponding signal line and the corresponding bus line, for supplying said analog image signals on the bus line to each of said signal lines, based on outputs of said flip-flops, wherein said image control circuit sets a voltage on the bus line at substantially an intermediate voltage between a maximum voltage and a minimum voltage of said analog image signals in a predetermined precharge period in at least one of a horizontal blanking period or a vertical blanking period, wherein said signal line driving circuit brings the bus line and said analog switches into conduction by controlling said analog switches in said precharge period, wherein said shift register turns ON all of said analog switches in said precharge period, wherein said shift register sets a timing for turning ON all of said analog switches, based on the start pulse inputted in a least one of said horizontal blanking period, or said vertical blanking period, wherein said shift register further includes:
a first register having a plurality of flip-flops, for turning ON or OFF the corresponding one or more analog switches, based on the outputs of the flip-flops; and
a second register having one or more flip-flops, for generating a timing signal for setting a timing to turn ON all of said analog switches, wherein said signal line driving circuit further comprises a clock generating means for generating a first shift clock to be supplied to a clock terminal of each of the flip-flops of said first register and a second shift clock to be supplied to the clock terminal of each of the flip-flops of said second register, said clock generating means outputting only said first shift clock in a period after a reset period finishes and before the flip-flop at the last stage of said first register outputs the shift pulse, without outputting said second shift clock, and outputting only said second shift clock in a period after the flip-flop at the last stage of said first register outputs the shift pulse and before the flip-flop at the last stage of said second register outputs the shift pulse, without outputting said first shift clock, wherein the flip-flops of said first register sequentially shift the start pulse in synchronism with said first shift clock, wherein the flip-flops of said second register sequentially shift the start pulse in synchronism with said second shift clock, and wherein said clock generating means further comprises:
a clock toggle means, the output logic of which is inverted when the shift pulse is outputted from the flip-flop at the last stage of said first register; and
a third logic calculation means for generating said first and second shift clocks, based on the output of said clock toggle means and a clock signal inputted from outside.

35. A flat-panel display according to claim 34 further comprising:

a plurality of fourth logic calculation means, each provided for each of the flip-flops of said first register, for controlling turning ON and OFF of the corresponding analog switches, based on the output of the corresponding flip-flops;

wherein said fourth logic calculation means turn ON the corresponding analog switch when a shift pulse is outputted from the flip-flops of said first register in a horizontal line period, and turn ON all of the analog switches when a shift pulse is outputted from the flip-flop at the last stage of said second register in at least one of said horizontal blanking period and said vertical blanking period.

* * * * *

UNITED STATES PATENT AND TRADEMARK OFFICE

CERTIFICATE OF CORRECTION

PATENT NO. : 6,417,847 B1
DATED : July 9, 2002
INVENTOR(S) : Mametsuka

It is certified that error appears in the above-identified patent and that said Letters Patent is hereby corrected as shown below:

Title page,
Item [73], the Assignee information should read:

-- [73] Assignee: Kabushiki Kaisha Toshiba, Kawasaki-shi (JP) --

Signed and Sealed this

Twenty-sixth Day of November, 2002

*Attest:*

*Attesting Officer*

JAMES E. ROGAN
*Director of the United States Patent and Trademark Office*